US006712746B1

(12) United States Patent
White

(10) Patent No.: US 6,712,746 B1
(45) Date of Patent: Mar. 30, 2004

(54) DISCHARGE AND TRANSFER SYSTEM FOR INTERFOLDED SHEETS

(75) Inventor: Barton J. White, Marinette, WI (US)

(73) Assignee: FPNA Acquisition Corporation, Green Bay, WI (US)

( * ) Notice: Subject to any disclaimer, the term of this patent is extended or adjusted under 35 U.S.C. 154(b) by 0 days.

(21) Appl. No.: 09/565,729

(22) Filed: May 5, 2000

Related U.S. Application Data

(60) Provisional application No. 60/132,846, filed on May 6, 1999.

(51) Int. Cl.[7] ..... B31F 7/00

(52) U.S. Cl. ..... 493/353; 493/357; 493/448

(58) Field of Search ..... 493/353, 433, 493/357, 359, 430, 448, 451

(56) References Cited

U.S. PATENT DOCUMENTS

| | | | |
|---|---|---|---|
| 3,163,413 | A | 12/1964 | Franke et al. |
| 3,301,111 | A | 1/1967 | Nystrand |
| 4,070,014 | A | 1/1978 | Takahashi |
| 4,396,336 | A | 8/1983 | Malamood |
| 4,475,730 | A | 10/1984 | Trogan |
| 4,494,741 | A | 1/1985 | Fischer et al. |
| 4,573,670 | A | 3/1986 | Felix |
| 4,673,382 | A | 6/1987 | Buck et al. |
| 4,700,939 | A | 10/1987 | Hathaway |
| 4,702,135 | A | 10/1987 | Kwasnitza |
| 4,717,135 | A | 1/1988 | Hathaway |
| 4,721,295 | A | 1/1988 | Hathaway |
| 4,730,762 | A | 3/1988 | Felix |
| 4,747,591 | A | 5/1988 | Beyer |
| 4,750,724 | A | 6/1988 | Herd et al. |
| 4,770,402 | A | 9/1988 | Couturier |
| 4,842,573 | A | 6/1989 | Peter et al. |
| 4,854,932 | A | 8/1989 | Schlottke et al. |
| 4,874,158 | A | 10/1989 | Retzloff |
| 4,921,235 | A | 5/1990 | Biagiotti et al. |
| 5,088,707 | A | 2/1992 | Stemmler |
| 5,147,273 | A | 9/1992 | Rottmann et al. |
| 5,503,379 | A | 4/1996 | Michalik et al. |
| 5,529,564 | A | 6/1996 | Hediger |

*Primary Examiner*—Eugene Kim
*Assistant Examiner*—Sameh H. Tawfik
(74) *Attorney, Agent, or Firm*—Boyle, Fredrickson, Newholm, Stein & Gratz, S.C.

(57) ABSTRACT

A discharge and transfer system for receiving interfolded sheets from a folding mechanism. The system includes a guide arrangement for receiving the interfolded sheets in a vertical direction from the discharge of the folding mechanism, and for guiding the interfolded sheets to a substantially horizontal direction of movement onto a discharge table. The sheets are moved along the discharge table by a belt arrangement. When the endmost group of sheets attains a predetermined position on the discharge table, a clamping mechanism engages the endmost group of sheets toward an end of the endmost group of sheets. The clamping mechanism includes a first clamping member which moves into the endmost group of sheets at a location outwardly of the separation between the endmost group of sheets and the next adjacent group of sheets, and further includes a second clamping member which moves toward the first clamping member to clamp a portion of the endmost group of sheets therebetween. The clamping mechanism is then moved laterally by a drive arrangement, which pulls the endmost group of sheets laterally in a direction along the longitudinal axis defined by the endmost group of sheets. Once the endmost group of sheets clears the next adjacent group of sheets, the clamping mechanism releases engagement with the endmost group of sheets, which is then transferred for subsequent processing. The clamping mechanism then returns to a ready position for clamping a subsequent group of sheets in a similar manner.

21 Claims, 4 Drawing Sheets

DISCHARGE AND TRANSFER SYSTEM FOR INTERFOLDED SHEETS

CROSS REFERENCE TO RELATED APPLICATION

This application is based on and claims priority from provisional patent application Ser. No. 60/132,846 filed on May 6, 1999.

BACKGROUND AND SUMMARY

This invention relates to an apparatus and method for separating and moving a group or "log" of interfolded sheets from the discharge of an interfolding apparatus, such as a pair of folding rolls.

In forming packaged interfolded sheets, such as papertowels, a pair of webs are cut into individual sheets, and the sheets from each web are supplied to one of a pair of cooperating folding rolls. The folding rolls function to interfold the sheets in a conventional manner, and the interfolded sheets are typically discharged in a vertical stack. When a desired sheet count is attained, separating fingers are inserted into the stack for separating a lower portion of the stack from the remainder of the stack, for subsequent processing, such as wrapping the stack and cutting the stack in individual sections corresponding to a pack of interfolded sheets.

An example of a separating system is disclosed in U.S. Pat. No. 4,770,402. In this system, a finger is inserted into the stack discharged from the folding rolls when a predetermined sheet count is attained. The finger supports the sheets located above the finger and below the folding rolls. The sheets below the finger, which comprise the sheets to be separated and discharged for subsequent processing, are supported by a support member and another finger, which move downwardly after the first finger has been inserted into the stack for supporting the sheets thereabove. Downward movement of the support member and the second finger separate the sheets below the first finger from the sheets above the first finger. While this type of discharge system is functional to separate a predetermined number of interfolded sheets from a stack, it involves disadvantages associated with support of the stack and downward movement of the section of the sheets which are separated from the stack.

It is an object of the present invention to provide an improved arrangement for separating a predetermined number of interfolded sheets from a series of interfolded sheets discharged from a folding arrangement. It is another object of the invention to provide such a system which takes advantage of a separation in the interfolded sheets to separate an endmost group of sheets from the remainder of the sheets without relative axial movement of the endmost sheets from the remainder of the sheets. It is a further object of the invention to provide such a system which accomplishes separation of the endmost group of sheets by moving the endmost group of sheets in a transverse direction relative to the remainder of the sheets. A still further object of the invention is to provide such a system which accomplishes separation of the endmost group of sheets without vertical movement of the sheets. Yet another further object of the invention to provide such a system which accomplishes separation of the endmost group of sheets without having to provide a vertical support for the remainder of the sheets. A still further object of the invention is to provide such a system which is relatively simple in its components and operation, and which provides significant advantages in separation and discharge of a group of sheets from a folding arrangement and for subsequent processing of the group of sheets.

The invention contemplates a method of separating a group of interfolded sheets from a series of interfolded sheets discharged from a sheet folding arrangement, such as a pair of folding rolls. The sheets are discharged from the folding arrangement in a first direction. The invention involves forming intermittent separations in the interfolded sheets, which function to separate the interfolded sheets into groups of interfolded sheets, including an endmost group of sheets. The invention further involves engaging the endmost group of sheets with a clamping mechanism, and moving the clamping mechanism laterally in a direction transverse to the first direction so as to exert a pulling force on the endmost group of sheets. The separation between the endmost group of sheets and the next adjacent group of sheets functions to enable the endmost group of sheets to separate from, and move laterally relative to, the next group of sheets, so as to separate the endmost group of sheets for subsequent processing.

The sheets are initially discharged from the folding arrangement in a substantially vertical direction, and the invention involves altering the direction of movement of the sheets from the vertical direction prior to engagement of the endmost group of sheets with the clamping mechanism. In a preferred form, the direction of movement of sheets is changed from vertical to horizontal, such that the endmost group of sheets is supplied by substantially horizontal movement to the clamping mechanism. A guide arrangement is located at the discharge of the folding arrangement for receiving the sheets from the folding arrangement and initially forming a vertical stack of sheets, and for thereafter guiding movement of the sheets from vertical to horizontal. The guide arrangement discharges the sheets to a support surface of a discharge table, which may be provided with a series of belts for moving the sheets horizontally on the support surface. A series of pivotable fingers engage the end of the stack of interfolded sheets as the sheets are supported on the support surface of the discharge table. Engagement of the fingers with the end of the stack prevents the sheets from falling over onto the support surface of the discharge table as the sheets are moved on the support surface.

The clamping mechanism includes a pair of clamping members which are operable to engage the endmost group of sheets. A first clamping member is movable from an inoperative position above the sheets, to an operative position in which the first clamping member is inserted into the endmost group of sheets at a location outwardly of the separation between the endmost group of sheets and the next adjacent group of sheets. A second clamping member engages the outermost sheet in the endmost group of sheets, and is movable toward the first clamping member for exerting a clamping force on the sheets between the first and second clamping members. The clamping members are preferably located so as to engage the sheets toward and of the endmost group of sheets. Operation of the clamping members may be initiated by sensing movement of the fingers which support the sheets in the endmost group of sheets.

Once the sheets are clamped between the first and clamping members, the clamping members are moved laterally in a direction transverse to the direction of movement of the sheets on the support surface. The sheets are preferably pulled by the clamping mechanism in a direction along the longitudinal axis of the group of sheets, by virtue of the tensile strength of the group of sheets. The separation between the endmost group of sheets and the next adjacent group of sheets enables the endmost group of sheets to separate from the next adjacent group of sheets when the endmost group of sheets is moved laterally by the clamping mechanism. The clamping mechanism is moved laterally a distance sufficient to enable the end of the endmost group of sheets to clear the next adjacent group of sheets, such that the endmost group of sheets is fully discharged from the stack of sheets. The endmost group of sheets is preferably moved onto a transfer table into a space between guides which extend upwardly through slots formed in the transfer table. After the endmost group of sheets is fully discharged from the discharge table, the first and second clamping members are released from engagement with the sheets and moved laterally so as to clear the end of the group of sheets. The guides are then moved within the slots so as to move the sheets laterally on the transfer table, for subsequent processing.

The invention further contemplates an apparatus for separating a group of interfolded sheets from a plurality of groups of interfolded sheets supplied by a folding arrangement, substantially in accordance with the foregoing summary.

Various other features, objects and advantages of the invention will become apparent from the following detailed description taken together with the drawings.

BRIEF DESCRIPTION OF THE DRAWINGS

The drawings illustrate the best mode presently contemplated of carrying out the invention.

In the drawings.

BRIEF DESCRIPTION OF THE DRAWINGS

Figure 1:
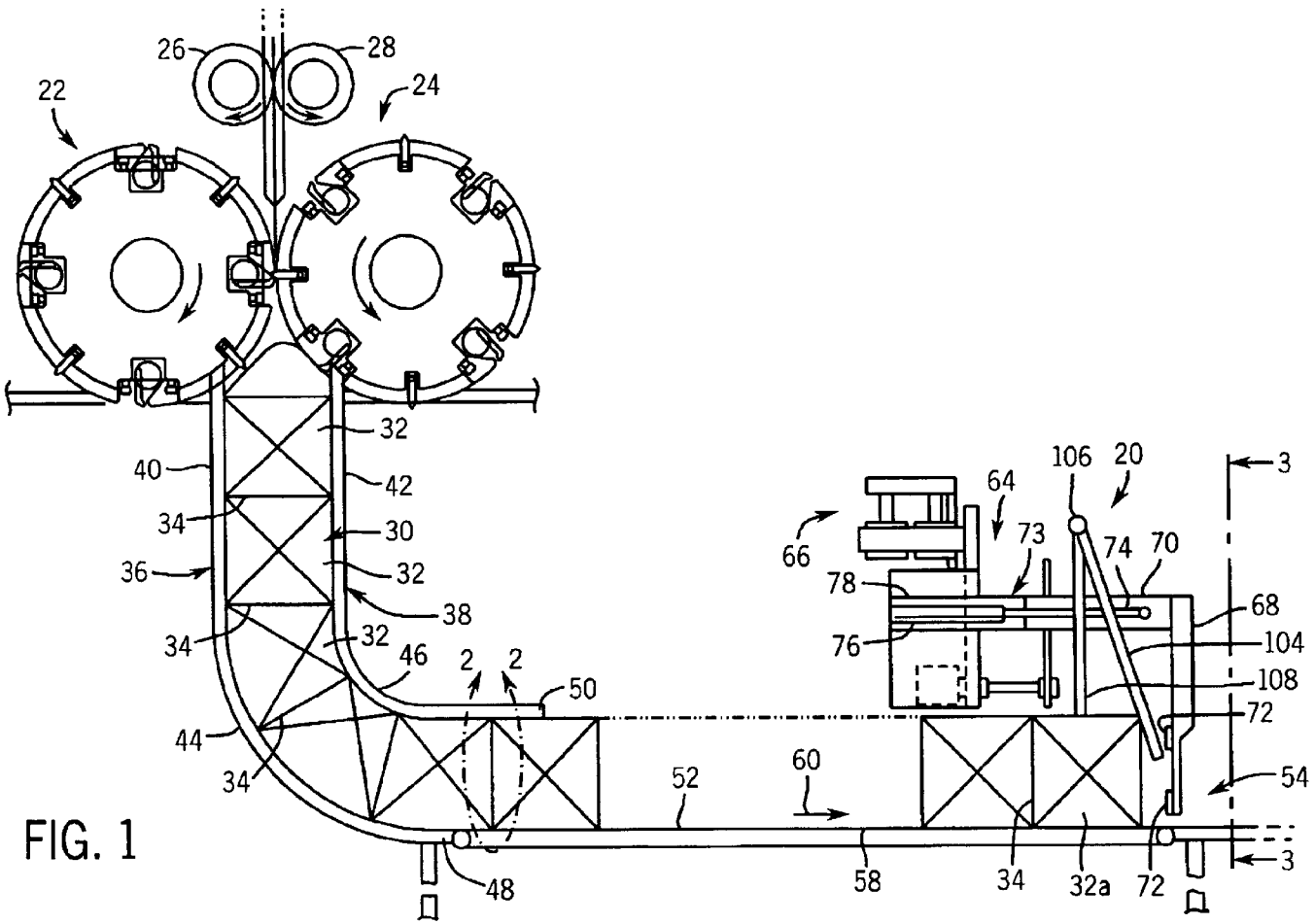
FIG. 1 is a side elevation view of a sheet folding mechanism for forming interfolded sheets separated into a series of groups of sheets, in combination with the discharge and transfer mechanism constructed according to the invention.
Figure 2:
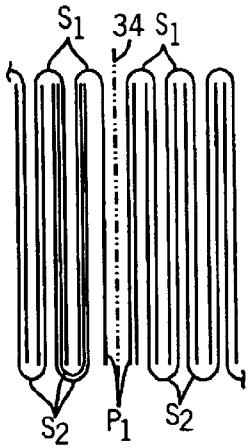
FIG. 2 schematically illustrates a portion of the interfolded sheets discharged from the folded mechanism of FIG. 1, with reference to line 2—2 of FIG. 1.

FIG. 1 illustrates a side elevation view of an apparatus 20, constructed according to the invention, located downstream from a pair of interfolding rolls 22, 24. In a manner as shown and described in pending application Ser. No. 09/228,708 filed Jan. 12, 1999, the disclosure of which is hereby incorporated by reference, rolls 22, 24 function to fold staggered, overlapping sheets into a stack 30 of interfolded sheets. Stack 30 consists of a series of groups or "logs" 32 of interfolded sheets of a predetermined sheet count, with a separation 34 formed between adjacent logs 32. Referring to FIG. 2, each log 32 is made up of interfolded sheets SI and S2, which are folded by rolls 22, 24 such that the panels of sheets S1 and S2 are interfolded, in a manner as is known, other than at separation 34. As described in the abovenoted application, separation 34 is formed by removing a sheet S2 upstream of folding rolls 22, 24 and feeding the removed sheet S2 through folding rolls 22, 24 along with the next upstream sheet S2. In this manner, rolls 22, 24 discharge a pair of sheets S1 which do not have an interfolded sheet S2 therebetween, and instead a pair of sheets S2 are interfolded into the next upstream log 32. Separation 34 is shown in exaggerated form in FIG. 2, and in reality the facing panels of sheets S1 at separation 34, shown at P1, are in direct contact with each other. With this arrangement, the stack 30 discharged from folding rolls 22, 24 is pre-separated into logs 32, each of which has a predetermined number of sheets S1 and S2 according to a desired sheet count.

After discharge from folding rolls 22, 24, stack 30 is received within a space defined between a pair of stack discharge guides 36, 38 which define upper vertical sections 40, 42, respectively, the upper ends of which terminate at the discharge of rolls 22, 24. Guides 36, 38 include lower curved sections 44, 46, respectively, at the lower ends of upper vertical sections 40, 42, respectively, and which merge into lower and upper horizontal sections 48, 50, respectively. With this arrangement, stack 30 is discharged horizontally onto a support surface 52 defined by a discharge table 54, which supports stack 30 above a supporting surface 56 such as a floor. A series of belts 58 are located within slots formed in support surface 52, and each belt 58 is driven in the direction of arrow 60 in order to move horizontal stack 30 away from the outlet defined between guide horizontal sections 48, 50. Apparatus 20 is adapted to remove the endmost log 32*a* from stack 30 supported on horizontal support surface 52 to transfer the endmost log 32*a* for subsequent downstream handling.

Figure 3:
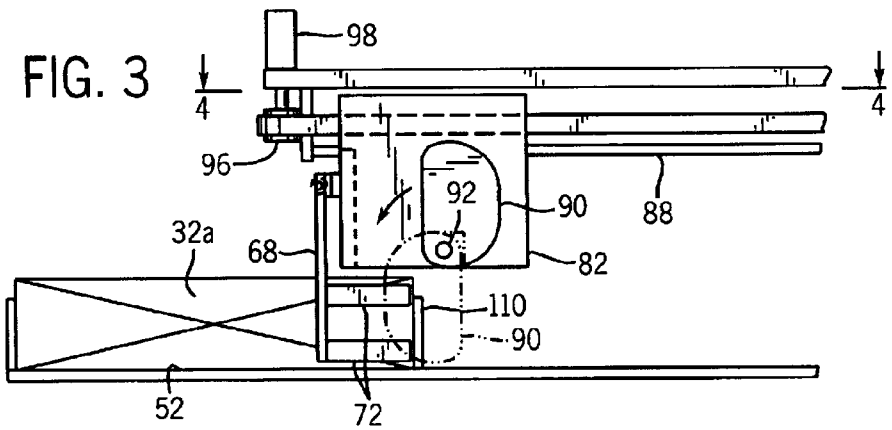
FIG. 3 is a partial elevation view of the transfer and discharge mechanism of the present invention, with reference to line 2–3 of FIG. 1.
Figure 4:
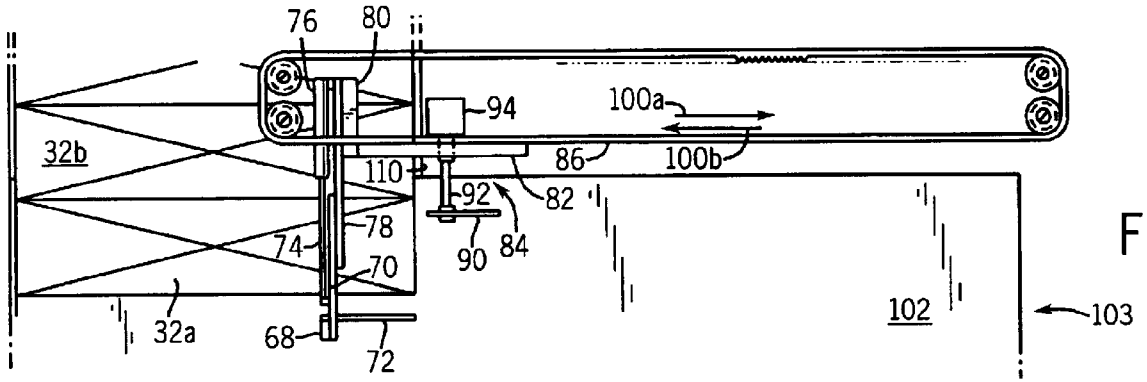
FIG. 4 is a top plan view partially in section, illustrating the discharge and transfer mechanism of the present invention with reference to line 4—4 of FIG. 3.

FIGS. 3 and 4 illustrate a front elevation view and a top plan view of apparatus 20, respectively. As shown in FIGS. 3 and 4, apparatus 20 generally includes a carriage 64 mounted to a drive mechanism 66.

Carriage 64 includes an outer clamping arm 68 extending downwardly from a horizontal slide member 70. A pair of horizontal clamping fingers 72 are mounted to outer clamping arm 68 toward its lower end, facing the end of endmost log 32*a*. Carriage 64 includes a cylinder assembly 73 having a rod 74 mounted for extension and retraction in a cylinder 76. Rod 74 is mounted to slide member 70, and cylinder 76 is fixedly mounted to a mounting member 78. With this arrangement, retraction of rod 74 into cylinder 76 results in inward movement of outer clamping arm 68 and fingers 72 toward the endmost log 32*a*, and extension of rod 74 results in outward movement of outer clamping arm 68 and clamping fingers 72 away from endmost log 32*a*.

Carriage 64 further includes a pair of support members 80 and 82 which are connected together at right angles to each other. The inner end of mounting member 78 is secured to support member 80, and an inner clamping mechanism 84 is mounted to support member 82. Support member 82 is engaged with a drive belt 86 for imparting movement to carriage 64 along a fixed slide member 88 to which support member 82 is mounted for sliding movement.

Inner clamping mechanism 84 includes a clamping disc 90 mounted to a shaft 92, which in turn is engaged with the rotatable output of an actuating motor 94 mounted to support member 82. Clamping disc 90 is eccentrically mounted to shaft 92, and is movable between an inoperative raised position and an operative lowered position in response to operation of actuating motor 94. Referring to FIG. 3, the inoperative raised position of clamping disc 90 is shown in solid lines, in which clamping disc 90 is located above endmost log 32. The operative lowered position of clamping disc 90 is illustrated in phantom in FIG. 3. In this position, clamping disc 90 is rotated downwardly into log 32 and is received between a pair of sheets S1 or S2 of endmost log 32*a*.

Drive belt 86 is engaged with a series of sprockets 96, at least one of which is driven in response to operation of a drive motor 98, for reciprocally moving drive belt 86 in the direction of arrows 100*a*, 100*b* (FIG. 4).

In operation, apparatus 20 functions as follows to move the endmost log 32*a* from support surface 52 of discharge table 54 laterally onto a horizontal support surface 102 of a transfer table 103.

As stack 30 is moved outwardly on discharge table support surface 52 by operation of belts 58, the outer end of stack 30 is supported by a series of laterally spaced fingers 104 (FIG. 1), each of which is mounted to a pivotable horizontal upper cross-member 106 supported above table 54 by a pair of supports 108. Fingers 104 are biased downwardly, either by a gravity bias or preferably by means of a torsion spring urging fingers 104 in a clockwise direction against the end of stack 30. In this manner, fingers 104 function to prevent the end sheets of endmost log 32*a* from falling over onto discharge table 54. As stack 30 is pushed outwardly on table support surface 52, fingers 104 rotate in a counterclockwise direction. A sensor is interconnected with fingers 104 and/or cross-member 106 for detecting movement of fingers 104 or cross-member 106 to a predetermined position indicating movement of the endmost log 32*a* in stack 30 to a position as shown in FIG. 1, in which the endmost log 32*a* is in a position ready for withdrawal from stack 30. Disc 90 and clamping arm 68 are in the positions of FIGS. 1 and 4 as endmost log 32*a* is moved outwardly on table support surface 52.

Figure 5:
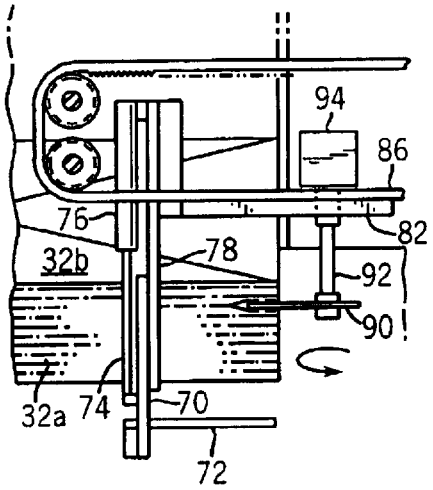
FIG. 5 is an enlarged partial top plan view illustrating an end of the discharge and transfer system of FIGS. 1–4 and the end of an endmost group of sheets, showing a first clamping member engaged with the endmost group of sheets.
Figure 6:
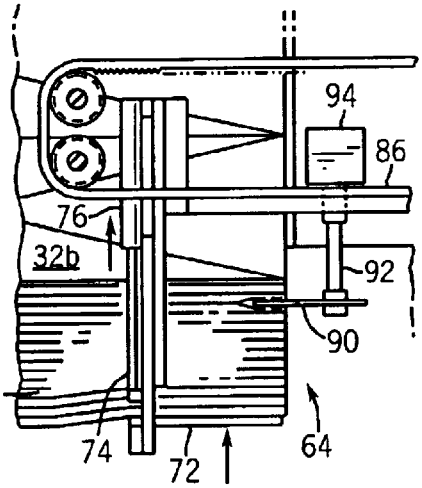
FIG. 6 is a view similar to FIG. 5, showing movement of a second clamping member into engagement with the end of the endmost group of sheets.

When fingers 104 attain the predetermined position signaling that the endmost log 32*a* is in a ready position for discharge from stack 30 by operation of apparatus 20, motor 94 is actuated to rotate shaft 92 so as to place disc 90 in its operative lowered position, as shown in phantom in FIG. 3. With reference to FIG. 5, when disc 90 is rotated to its operative lowered position in this manner, the lower end of disc 90 extends into the endmost log 32*a* between a pair of interfolded sheets, outwardly of separation 34 in endmost log 32*a*. The sensor for fingers 104 or cross-member 106 is positioned such that motor 94 is actuated at a time, during outward movement of stack 30 on table support surface 52, so as to ensure that disc 90 is moved to its operative position before separation 34 is moved past disc 90. Referring to FIG. 6, once disc 90 has been rotated to its operative position by operation of motor 94, cylinder assembly 73 is actuated so as to retract rod 74 and to thereby move clamping arm 68 inwardly toward the outer end of endmost log 32*a*. This retraction of rod 74 and inward movement of clamping arm 68 results in engagement of clamping fingers 72 with the outer end of endmost log 32*a*. The rightward end of endmost log 32*a* is thus clamped between clamping fingers 72 and disc 90, which compresses the sheets of endmost log 32*a* located between clamping fingers 72 and disc 90.

Figure 7:
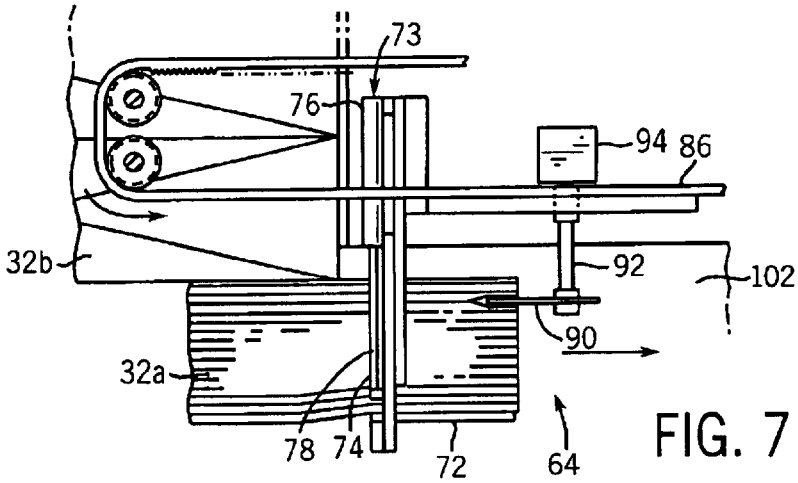
FIG. 7 is a view similar to FIGS. 5 and 6, showing movement of the clamping mechanism for moving the endmost group of sheets laterally relative to the next adjacent group of sheets.
Figure 8:
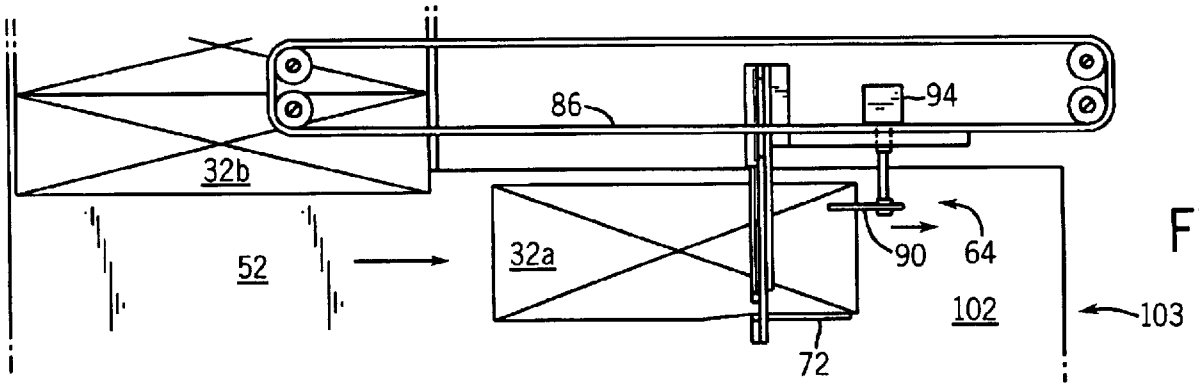
FIG. 8 is a top plan view of the discharge and transfer mechanism similar to FIG. 4, showing movement of the endmost group of sheets to a position clear of the next adjacent group of sheets.

Once the end of endmost log 32*a* is clamped between disc 90 and clamping fingers 72 as shown in FIG. 6, motor 98 is operated to drive belt 86, as shown in FIG. 7, so as to move carriage 64 rightwardly in response to lateral rightward movement of belt 86, in the direction of arrow 100*a*. Endmost log 32*a* is drawn along with carriage 64, as shown in FIG. 7, and is moved laterally relative to the next adjacent log, shown at 32*b*. The tensile strength of log 32*a* enables log 32*a* to be pulled laterally in this manner, and the presence of separation 34 between logs 32*a* and 32*b* prevents the sheets of log 32*b* adjacent separation 34 from being moved laterally along with the sheets of log 32*a*. A vertical support wall 110 is positioned to engage the rightward end of log 32*b* and logs 32 upstream of log 32*b*, to ensure a clean separation of log 32*a* as shown in FIG. 7. Operation of motor 98 is continued so as to move carriage 64 to a position as shown in FIG. 8, in which log 32*a* is completely separated from log 32*b*, i.e. the leftward end of log 32*a* is moved past the rightward end of log 32*b*. When carriage 64 reaches the position of FIG. 8, motor 94 is actuated so as to move disc 90 back to its inoperative raised position in which disc 90 is disengaged from log 32, and cylinder assembly 73 is operated so as to extend rod 74 and to move clamping fingers 72 out of engagement with the outer end of log 32*a*.

Figure 9:
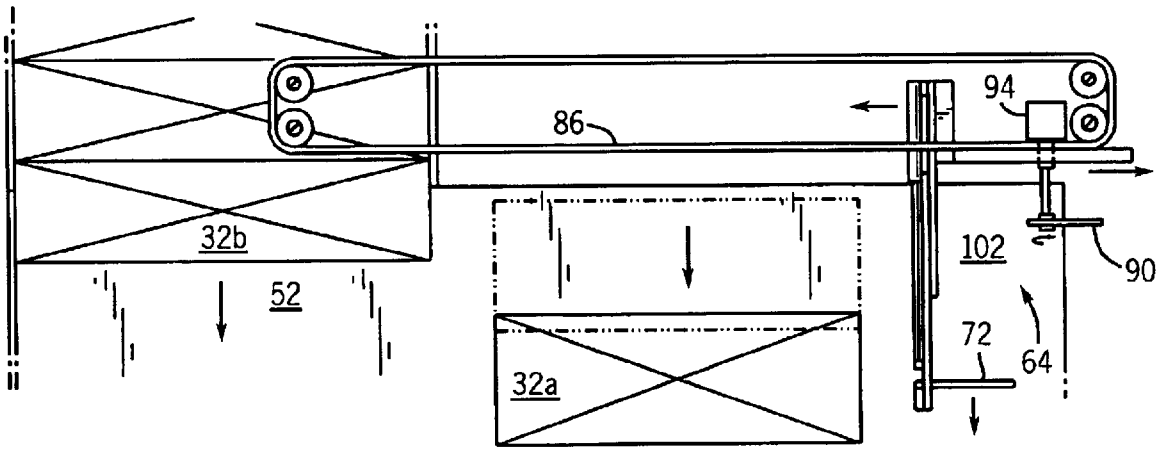
FIG. 9 is a view similar to FIG. 8 showing disengagement of the clamping members from the endmost group of sheets and subsequent movement of the endmost group of sheets for further processing.

A series of vertical guides 112 extend upwardly through slots 114 formed in transfer table support surface 102, and define a space within which log 32*a* is received upon lateral rightward movement of log 32*a* in response to movement of carriage 64. After disc 90 is moved to its inoperative position and cylinder assembly 73 operated so as to extend clamping fingers 72 away from the outer end of log 32*a*, rightward movement of carriage 64 is continued by operation of motor 98 so as to move carriage 64 rightwardly clear of the rightward end of log 32*a*, as shown in FIG. 9. Guide members 112 are then moved within slots 114 in a direction transverse to movement of log 32*a*, as shown at arrow 116 in FIG. 9, to move log 32*a*into a position for subsequent processing, such as for feeding into a banding mechanism for compressing and wrapping log 32*a*, after which log 32*a* is cut into sections to form individual packs of interfolded sheets. After log 32*a* is moved laterally by vertical guides 112, motor 98 is then operated to drive belt 86 in the direction of arrow 100b (FIG. 4), so as to return carriage 64 to its ready position of FIG. 4 in preparation for subsequent operation to discharge log 32*b* from stack 30.

The drawings and description illustrate carriage 64 as being operable to move log 32*a* the entire extent of its lateral movement relative to stack 30. It is also contemplated that carriage 64 may be operated to provide initial separation of log 32*a* as shown in FIGS. 5 and 6 and to provide a separate mechanism for thereafter clamping the end of log 32*a* and moving log 32*a* the remaining extent of its lateral movement to attain the position of FIG. 8. In this embodiment, carriage 64*a* is mounted for movement to a separate actuating member such as a cylinder assembly for movement between positions as shown in FIGS. 5 and 6. The separate clamping mechanism is mounted to a separate carriage engaged with drive belt 86 for moving log 32*a* laterally after disengagement of clamping fingers 72 and disc 90 from log 32*a*, as described with respect to FIG. 9. In this manner, the separate clamping mechanism and carriage functions to move log 32*a* laterally while carriage 64 is returned to its ready position for engagement with log 32*b*, which may occur even before the separate clamping mechanism is disengaged from log 32*a* and returned to its ready position for engaging log 32*b*. This ensures that the timing of apparatus 20 is such as to provide continuous and uninterrupted discharge of the endmost log 32 from stack 30 as stack 30 is moved on table support surface 52.

Various alternatives and embodiments are contemplated as being within the scope of the following claims particularly pointing out and distinctly claiming the subject matter regarded as the invention.

I claim:

1. A method of separating a group of interfolded sheets from a series of interfolded sheets discharged from a sheet folding mechanism, comprising the steps of:

forming intermittent separations in the interfolded sheets so as to form the interfolded sheets into adjacent, separated groups of interfolded sheets including an endmost group of sheets, wherein each of the adjacent groups of sheets is elongated and extends along a longitudinal horizontal axis;

advancing the elongated groups of sheets toward a clamping mechanism in a forward direction, wherein the forward direction is oriented generally perpendicular to the longitudinal axes of the groups of sheets;

engaging the clamping mechanism with the endmost group of sheets at a first elevation; and moving the clamping mechanism in a lateral horizontal direction while maintaining the clamping mechanism at the first elevation and in engagement with the endmost group of sheets, wherein the lateral direction is oriented parallel to the longitudinal axis of the endmost group of sheets and perpendicular to the forward direction, and wherein movement of the clamping mechanism in the lateral horizontal direction exerts an axial pulling force on the endmost group of sheets, wherein the separation between the endmost group of sheets and the next adjacent group of sheets enables the endmost group of sheets to be displaced in the lateral horizontal direction relative to the next adjacent group of sheets, and wherein movement of the clamping mechanism at the first elevation in the lateral horizontal direction moves the endmnost group of sheets laterally and horizontally along the longitudinal axis of the endmost group of sheets while maintaining the endmost group of sheets at the first elevation, to separate the endmost group of sheets from the next adjacent group of sheets.

2. The method of claim 1, wherein the sheets are discharged from the folding mechanism in a vertical direction, and wherein the step of advancing the sheets in the forward direction comprises moving the sheets in a horizontal direction subsequent to discharge from the folding mechanism, wherein the endmost group of sheets is supplied by horzoital movement to the clamping mechanism.

3. The method of claim 2, wherein the sheets are moved through a guide arrangement to alter the direction of movement of the sheets from a vertical direction adjacent the folding mechanism to a horizontal direction downstream therefrom.

4. The method of claim 3, wherein a plurality of groups of interfolded sheets are supported on a horizontal surface while the clamping mechanism engages the endmost group of sheets and is operable to move the endmost group of sheets in the lateral horizontal direction relative to the next adjacent group of sheets.

5. The method of claim 2, wherein the step of engaging the clamping mechanism with the endmost group of sheets is carried out by engaging a first clamping member outwardly of the endmost separation in the interfolded sheets such that the first clamping member is engaged within the endmost group of sheets, and engaging a second clamping member with the endmost group of sheets outwardly of the first clamping member.

6. The method of claim 5, herein the first clamping member is vertically moveable from a retracted position above the endmost group of sheets to an engaged position in which the first clamping member is engaged within the endmost group of sheets.

7. The method of claim 5, wherein the second clamping member is movable in a substantially horizontal direction between an engaged position in which the second clamping member engages the endmost group of sheets and an inoperative position in which the second clamping member is moved horizontally outwardly out of engagement with the endmost group of sheets.

8. A method of separating a group of interfolded sheets from a series of interfolded sheets discharged from a sheet folding mechanism, wherein the sheets are discharged from the folding mechanism in a substantially vertical direction, comprising the steps of:

forming intermittent separations in the interfolded sheets so as to separate the interfolded sheets into groups of interfolded sheets including an endmost group of sheets;

moving the sheets in a substantially horizontal direction subsequent to discharge from the folding mechanism, wherein the endmost group of sheets is supplied by substantially horizontal movement to a clamping mechanism;

supporting the endmost group of sheets during horizontal movement of the endmost group of sheets;

engaging the clamping mechanism with the endmost group of sheets; and moving the clamping mechanism laterally in a direction transverse to the first direction to exert a pulling force on the endmost group of sheets, wherein the separation between the endmost group of sheets and the next adjacent group of sheets, functions to enable the endmost group of sheets to be moved laterally relative to the next adjacent group of sheets.

9. The method of claim 8, wherein the step of supporting the endmost group of sheets is carried out by a series of pivotable support members which engage the endmost group of sheets.

10. The method of claim 9, further comprising the step of engaging the clamping mechanism with the endmost group of sheets in response to movement of the support members.

11. A method of separating a group of interfolded sheets from a series of interfolded sheets discharged from a sheet folding mechanism, wherein the sheets are discharged from the folding mechanism in a substantially vertical direction, comprising the steps of:

forming intermittent separations in the interfolded sheets so as to separate the interfolded sheets into groups of interfolded sheets including an endmost group of sheets;

moving the sheets in a substantially horizontal direction subsequent to discharge from the folding mechanism, wherein the endmost group of sheets is supplied by substantially horizontal movement to a clamping mechanism;

engaging the clamping mechanism with the endmost group of sheets by engaging a first clamping member outwardly of the endmost separation in the interfolded sheets such that the first clamping member is engaged within the endmost group of sheets, and engaging a second clamping member with the endmost group of sheets outwardly of the first clamping member; and moving the clamping mechanism laterally in a direction transverse to the first direction to exert a pulling force on the endmost group of sheets by laterally moving a carriage to which the first and second clamping members are mounted; wherein the separation between the endmost group of sheets and the next adjacent group of sheets, functions to enable the endmost group of sheets to be moved laterally relative to the next adjacent group of sheets.

12. The method of claim 11, wherein the step of moving the clamping mechanism laterally in a direction transverse to the first direction is carried out such that the endmost group of sheets is moved to a transfer position, and further comprising the step of disengaging the clamping mechanism from the endmost group of sheets when the endmost group of sheets is in the transfer position.

13. The method of claim 12, further comprising the step of moving the endmost group of sheets laterally for subsequent processing after disengagement of the clamping mechanism from the endmost group of sheets.

14. The method of claim 13, including the step of moving the endmost group of sheets into a space between a vertical guide arrangement, and wherein the step of laterally moving the endmost group of sheets is carried out by laterally moving the vertical guide arrangement.

15. A method of separating a group of interfolded sheets from a series of interfolded sheets discharged from a sheet folding mechanism, comprising the steps of:

forming intermittent separations in the interfolded sheets in the sheet folding mechanism, wherein the intermittent separations function to separate the interfolded sheets into a series of side-by-side groups of interfolded sheets including an enidmost group of sheets and a series of inner groups of sheets, wherein each group of sheets defines a length and terminates laterally spaced ends, and wherein each group of sheets extends along a longitudinal horizontal axis;

advancing the groups of sheets in a forward direction toward a reciprocating clamping mechanism;

engaging the clamping mechanism with the endmost group of sheets in a clamping location adjacent one of the laterally spaced ends of the endmost group of sheets without engaging the remainder of the length of the endmost group of sheets; and moving the clamping mechanism in a lateral horizontal direction along the longitudinal axis of the endmost group of sheets while maintaining engagement of the clamping mechanism with the endmost group of sheets in the clamping location without engaging the remainder of the length of the endmost group of sheets, wherein the lateral horizontal direction is perpendicular to the forward direction in which the sheets are advanced toward the clamping mechanism, and wherein movement of the clamping mechanism in the lateral horizontal direction exerts an axial separating force on the endmost group of sheets that moves the endmost group of sheets lengthwise in the lateral horizontal direction relative to the inner groups of sheets and along the longitudinal axis of the endmost group of sheets, wherein the separation between the endmost group of sheets and the next adjacent inner group of sheets functions to enable the endmost group of sheets to be separated from and moved laterally and horizontally relative to the next adjacent inner group of sheets.

16. The method of claim 15, wherein the step of moving the clamping mechanism is carried out such that the clamping mechanism is reciprocally moved in the lateral horizontal direction.

17. The method of claim 16, wherein the series of groups of interfolded sheets are supported on a support surface while the clamping mechanism engages the endmost group of sheets.

18. The method of claim 16, including the step of supporting the endmost group of sheets during movement of the groups of sheets on the support surface.

19. The method of claim 18, wherein the step of supporting the endmost group of sheets is carried out by a series of pivotable support members which engage the endmost group of sheets.

20. The method of claim 16, wherein the step of engaging the clamping mechanism with the endmost group of sheets is carried out by engaging a first clamping member outwardly of the endmost separation in the interfolded sheets such that the first clamping member is engaged within the endmost group of sheets, and engaging a second clamping member with the endmost group of sheets outwardly of the first clamping member.

21. The method of claim 20, wherein the step of moving the clamping mechanism in the lateral horizontal direction is carried out by laterally moving a carriage to which the first and second clamping members are mounted.

* * * * *